US007293428B2

(12) United States Patent
Itsuki et al.

(10) Patent No.: US 7,293,428 B2
(45) Date of Patent: Nov. 13, 2007

(54) REFRIGERATING MACHINE

(75) Inventors: Hiroyuki Itsuki, Gunma (JP); Akira Sugawara, Saitama (JP); Hiroshi Mukaiyama, Gunma (JP); Etsushi Nagae, Gunma (JP); Satoshi Imai, Gunma (JP); Kazuaki Mizukami, Gunma (JP); Ichiro Kamimura, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 185 days.

(21) Appl. No.: 11/074,663

(22) Filed: Mar. 9, 2005

(65) Prior Publication Data

US 2005/0198996 A1 Sep. 15, 2005

(30) Foreign Application Priority Data

Mar. 15, 2004 (JP) ..... P2004-072854

(51) Int. Cl.
*F25B 43/00* (2006.01)

(52) U.S. Cl. ..... 62/512; 62/222

(58) Field of Classification Search ..... 62/512, 62/515, 179, 222, 503
See application file for complete search history.

(56) References Cited

U.S. PATENT DOCUMENTS 3,019,614 A * 2/1962 Schubert et al. ..... 62/114
4,416,119 A * 11/1983 Wilson et al. ..... 62/149
5,150,583 A 9/1992 Jaster et al.
2003/0131618 A1 7/2003 Doi et al.

FOREIGN PATENT DOCUMENTS

| | | |
|---|---|---|
| AU | 766121 B2 | 5/2002 |
| EP | 0 541 343 | 5/1993 |
| EP | 1 241 417 A | 9/2002 |
| JP | 08 021664 A | 1/1996 |
| JP | 2003-106693 | 4/2003 |
| WO | WO 99/10686 A | 3/1999 |

OTHER PUBLICATIONS

Lavrenchenko, G.K. et al.: "Characteristics of Voorhees refrigerating machine with hermetic piston compressor producing refrigeration at one or two temperature levels," International Journal of Refrigeration, Oxford, GB, vol. 20, No. 7, 1997, pp. 517-527.
European Search Report for Corresponding Patent Application EP 05 00 500, Dispatched Mar. 27, 2006.

* cited by examiner

*Primary Examiner*—Melvin Jones
(74) *Attorney, Agent, or Firm*—McDermott Will & Emery LLP

(57) ABSTRACT

A refrigerating machine comprising a compressor, a radiator, a pressure-reducing device, a gas-liquid separator, plural heat absorbers functioning selectively in different temperature zones, a unit for allowing introduction of gas refrigerant separated in the gas-liquid separator into an intermediate pressure portion of the compressor, and a low pressure side circuit in which liquid refrigerant separated in the gas-liquid separator is circulated, wherein the low pressure side circuit is provided with at least a heat absorber functioning in a low temperature zone.

3 Claims, 9 Drawing Sheets

REFRIGERATING MACHINE

BACKGROUND OF THE INVENTION

1. Field of the Invention

The present invention relates to a refrigerating machine having a unit for selectively introducing gas refrigerant separated in a gas-liquid separator into an intermediate pressure portion of a compressor.

2. Description of the Related Art

In general, there is known a refrigerating machine having a compressor, a radiator, a pressure-reducing device, a gas-liquid separator and a unit which can introduce gas refrigerant separated in the gas-liquid separator into an intermediate pressure portion of the compressor as disclosed in JP-A-2003-106693 (hereinafter referred to as "Patent Document 1"). In this type of refrigerant machine, gas refrigerant separated in the gas-liquid separator is introduced into the intermediate pressure portion of the compressor while kept to a gas state, so that there is achieved an effect that the efficiency of the compressor can be enhanced.

In some cases, this type of refrigerating machine is equipped with a heat absorbing unit containing heat absorbers which selectively function in different temperature zone in a refrigerating cycle. For example, when this refrigerating machine is applied to a refrigerator (fridge) having a refrigerating chamber and a freezing chamber, heat absorbers functioning as a refrigerator and a freezer are disposed in the refrigerating cycle, and a refrigerating or freezing operation is carried out by using any one of the heat absorbers. In this case, it is important to carry out the refrigerating or freezing operation without reducing the efficiency under any operation.

SUMMARY OF THE INVENTION

Therefore, an object of the present invention is to provide a refrigerating machine in which when heat absorbing units selectively functioning in different temperature zones are provided in the refrigerating cycle, the high efficiency operation can be performed in any temperature zone without reducing the efficiency.

In order to attain the above object, according to the present invention, there is provided a refrigerating machine comprising: a compressor; a radiator; a pressure-reducing device; a gas-liquid separator; plural kinds of absorbers functioning selectively in different temperature zones; a unit for allowing introduction of gas refrigerant separated in the gas-liquid separator into an intermediate pressure portion of the compressor, and a low pressure side circuit in which liquid refrigerant separated in the gas-liquid separator is circulated, wherein the low pressure side circuit is provided with at least a heat absorber functioning in a low temperature zone.

In this case, the low pressure side circuit may be provided with all the absorbers arranged in parallel.

Furthermore, the refrigerating machine may be provided with a bypass circuit for bypassing the pressure-reducing device, the gas-liquid separator and an absorber functioning in a low temperature zone, wherein the bypass circuit is provided with an absorber functioning in a high temperature zone.

Still furthermore, an absorber functioning in a high temperature zone may be provided between the pressure-reducing device and the gas-liquid separator.

Still furthermore, refrigerant with which a high pressure side is set to supercritical pressure during operation may be filled in the refrigerant circuit.

According to the present invention, the low pressure side circuit for circulating the liquid refrigerant separated in the gas-liquid separator is provided, and at least the absorber functioning in the low temperature zone out of the plural absorbers is provided to the low pressure side circuit, so that the high efficiency operation can be performed as the overall device.

DETAILED DESCRIPTION OF THE PREFERRED EMBODIMENTS

Preferred embodiments according to the present invention will be described hereunder with reference to the accompanying drawings.

Figure 1:
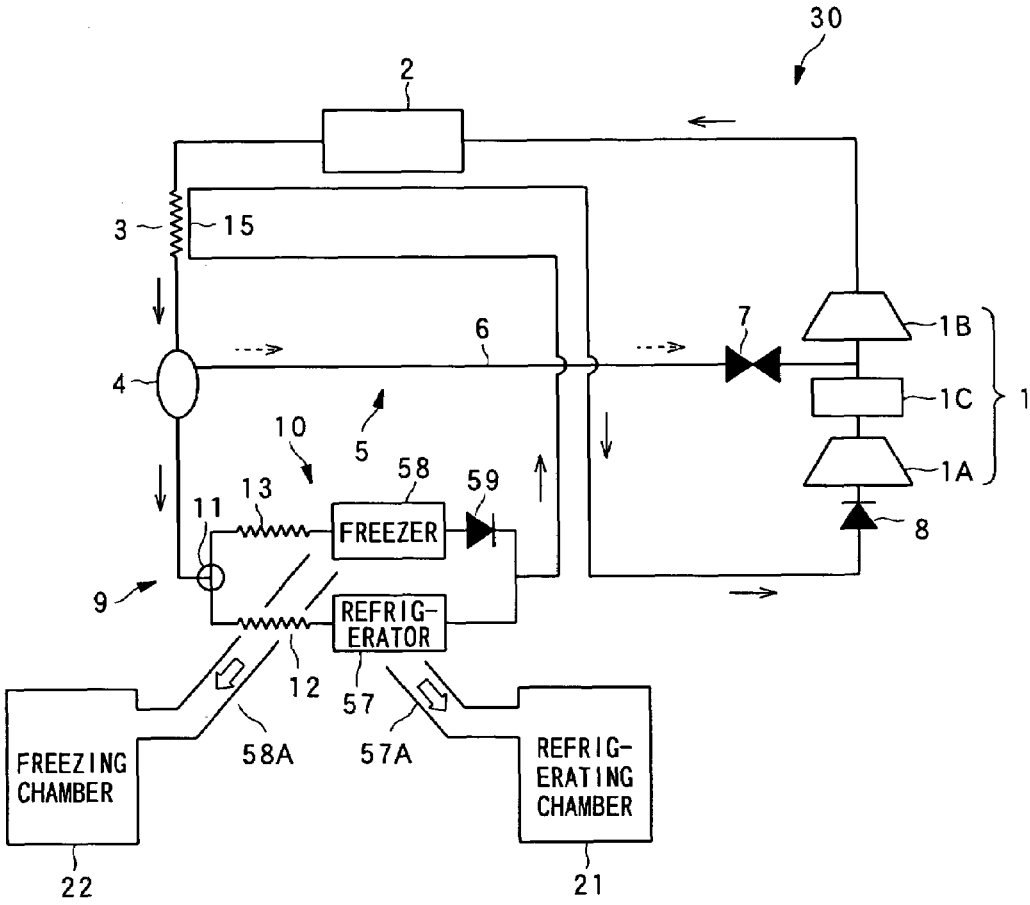
FIG. 1 is a refrigerant circuit diagram showing an embodiment of a refrigerating machine according to the present invention.

FIG. 1 is a refrigerant circuit diagram showing an embodiment of the present invention.

A refrigerating machine 30 has a compressor 1, a radiator 2, a pressure-reducing device 3 and a gas-liquid separator 4. A refrigerant circuit extending from the compressor 1 through the radiator 2 to the inlet port of the pressure-reducing device 3 constitutes a high pressure side circuit. The pressure-reducing device 3 is designed so that the opening degree of the diaphragm thereof is variable. By varying the opening degree, the pressure of refrigerant is reduced until the refrigerant reaches the gas-liquid separator 4, and a lot of gas refrigerant occurs. Under this state, the refrigerant is input to the gas-liquid separator 4, whereby the separation efficiency in the gas-liquid separator 4 can be varied. The compressor 1 is a two-stage compressor, and it contains a first-stage compressing portion 1A, a second-stage compressing portion 1B and an intermediate cooler 1C between the first-stage compressing portion 1A and the second-stage compressing portion 1B. Reference numeral 8 represents a check valve.

The refrigerating machine 30 has an introducing unit 5 which can introduce gas refrigerant separated in the gas-liquid separator 4 to the intermediate portion of the compressor 1, that is, between the intermediate cooler 1C and the second-stage compressing portion 1B. The compressor is not limited to the two-stage compressor. For example, when the compressor is a one-stage compressor, the introducing unit 5 may return the refrigerant to the intermediate pressure portion of the one-stage compressor. The introducing unit 5 comprises a gas pipe 6 and an opening/closing valve 7 provided to the gas pipe 6. When the opening/closing valve 7 is opened, the gas refrigerant separated in the gas-liquid separator 4 is passed through the gas pipe 6, and introduced to the intermediate pressure portion of the compressor 1 as indicated by an arrow of a broken line due to the pressure difference in the gas pipe 6.

Furthermore, the refrigerating machine 30 is provided with a low pressure side circuit 9 for circulating liquid refrigerant separated in the gas-liquid separator 4, and the low pressure side circuit 9 is provided with a heat absorbing unit 10 which functions selectively in different temperature zones. The heat absorbing unit 10 comprises a three-way valve 11, a first capillary tube 12, a heat absorber 57 for refrigeration which is provided to the first capillary 12 in series, a second capillary tube 13 provided in parallel to the above elements, and a heat absorber 58 for freezing which is provided to the second capillary tube 13 in series. Reference numeral 59 represents a check valve.

The resistance value of the first capillary tube 12 is set to be larger than the resistance value of the second capillary tube 13. Therefore, when the refrigerant is made to flow to the first capillary tube 12 by switching the three-way valve 11 and also the driving frequency of the compressor 1 is reduced, the flow amount of the refrigerant flowing into the heat absorber 57 is reduced, the evaporation temperature at the heat absorber 57 is increased and thus refrigerating operation is carried out. When the driving frequency is fixed and only the resistance value of the capillary tube is increased, the evaporation temperature is lowered. Furthermore, when the refrigerant is made to flow to the second capillary tube 13 by switching the three-way valve 11 and the driving frequency of the compressor 1 is increased, the flow amount of the refrigerant flowing into the heat absorber 58 is increased, the evaporation temperature is lowered and the freezing operation is carried out. The refrigerant passed through the heat absorber 58 is passed through the check valve 59 and then or directly to a heat exchanger 15 disposed near to the pressure-reducing device 3, and heat-exchanged by the heat exchanger 15 to be heated. The refrigerant thus heated is passed through a check valve 8, and then returned to the suction portion of the compressor 1.

In this construction, cold air passed through the heat heater 57 is passed through the duct 57A to the refrigerating chamber 21, and the cold air passed through the heat absorber 58 is passed through the duct 58A to the freezing chamber 22.

The refrigerant with which the high pressure side is set to supercritical pressure during operation, for example, carbon dioxide refrigerant is filled in the refrigerant circuit described above.

Figure 2:
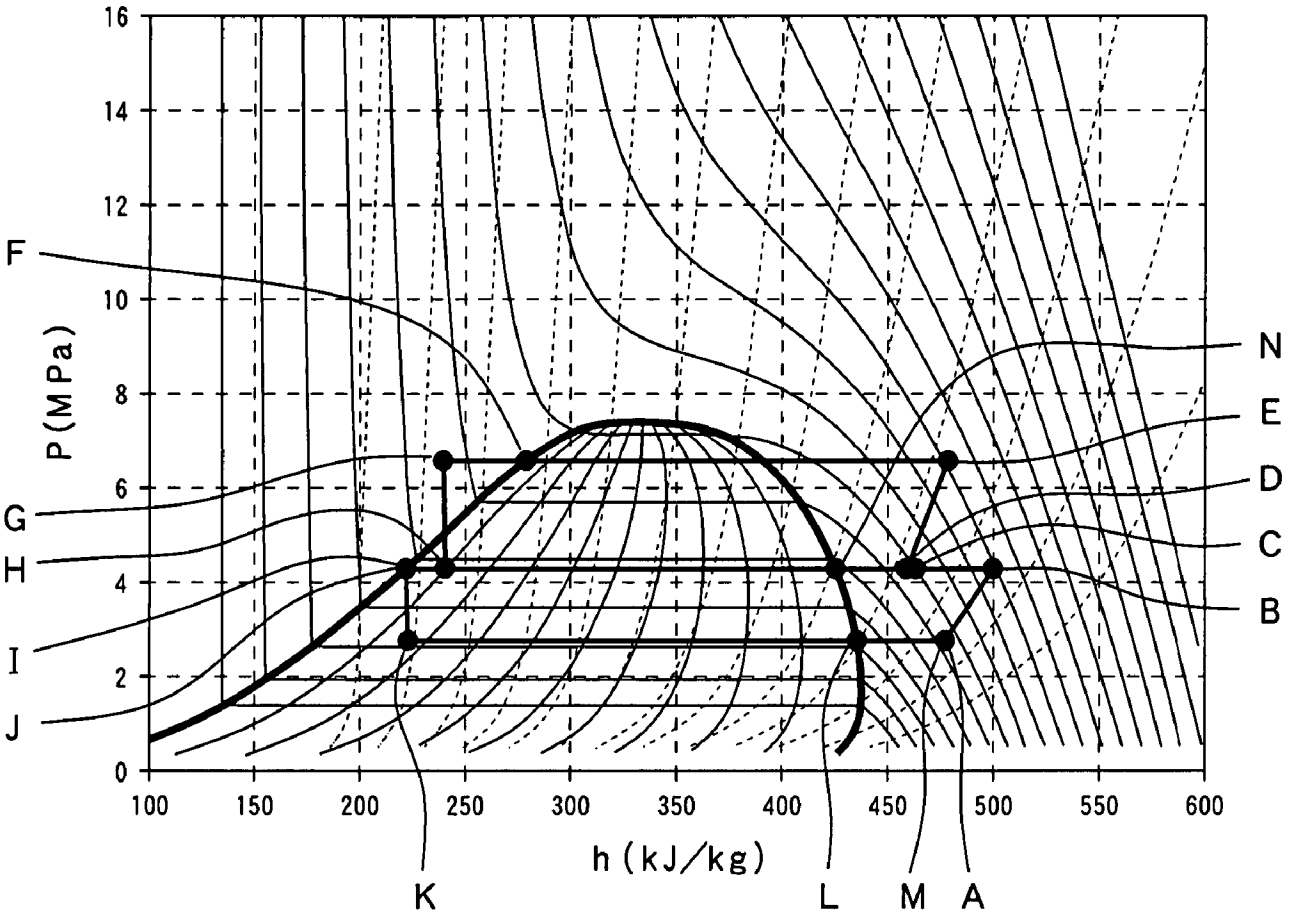
FIG. 2 is an enthalpy-pressure diagram of a refrigerating cycle.

FIG. 2 is an enthalpy-pressure (ph) diagram of the refrigerating cycle containing the two-stage compressor of this embodiment. In this embodiment, under such a condition that the outside air temperature is increased to 30° or more in summer or the load is increased, the high pressure side circuit is driven at supercritical pressure during operation as indicated by the enthalpy-pressure (ph) diagram of FIG. 3. The refrigerant with which the high-pressure circuit is driven at supercritical pressure may contain ethylene, diborane, ethane, nitride oxide or the like.

Next, the refrigerating cycle of the two-stage compressor 1 will be described with reference to FIGS. 2 and 3.

Figure 3:
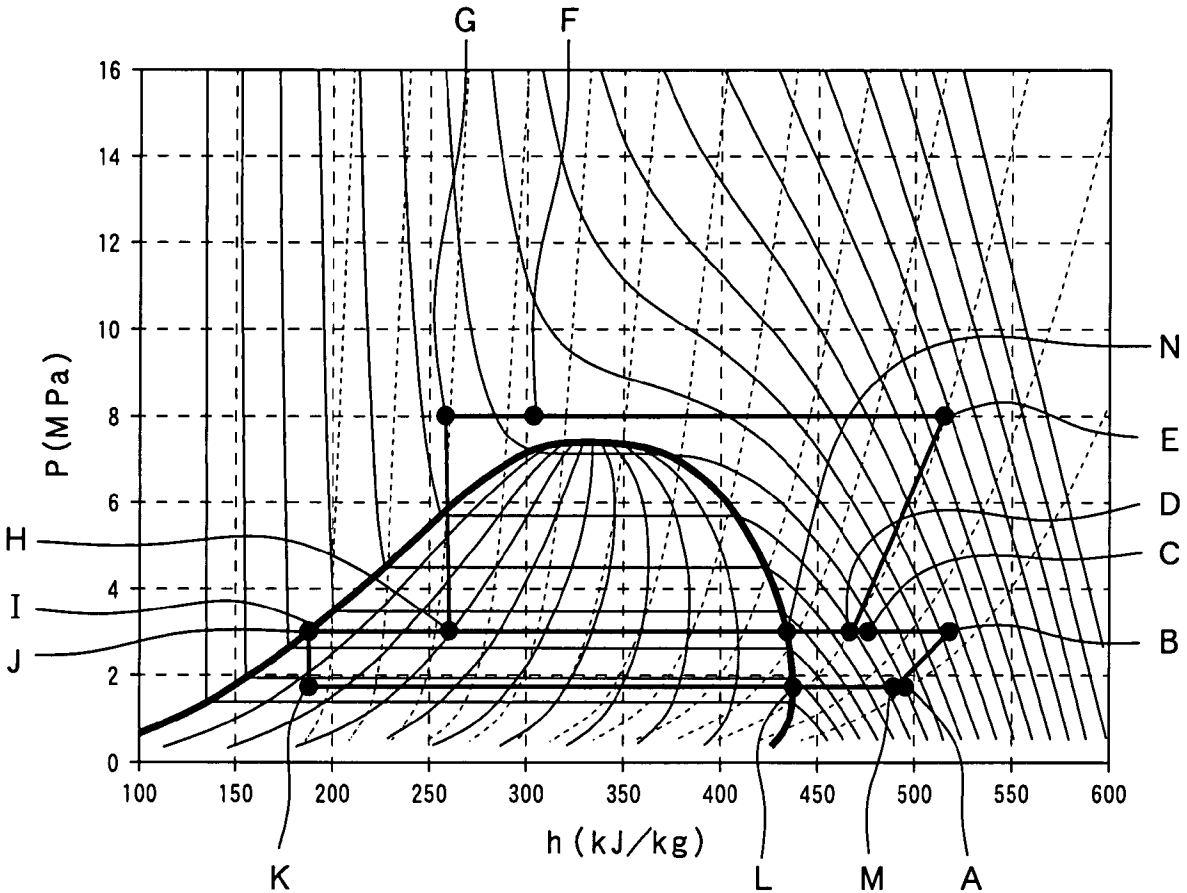
FIG. 3 is an enthalpy-pressure diagram of a supercritical cycle.

In FIGS. 2 and 3, "a" represents a ph value at the suction port of the first-stage compressing portion 1A, "b" represents a ph value at the discharge port of the first-stage compressing portion 1A, "c" represents a ph value at the outlet port of the intermediate cooler 1C, "d" represents a ph value at the suction port of the second-stage compressing portion 1B, and "e" represents the discharge port of the second-stage compressing portion 1A. The refrigerant discharge from the compressor 1 is passed through the radiator 2 and circulated and cooled. "f" represents a ph value at the outlet port of the radiator 2, "g" represents a ph value at the inlet port of the pressure-reducing device 3, and "h" represents a ph value at the outlet port of the pressure-reducing device 3. Under this state, the refrigerant becomes a two-phase mixture of gas/liquid. The ratio of gas and liquid corresponds to the ratio of the length of a line segment (gas) h-i and the length of a line segment (liquid) h-n. The refrigerant enters the gas-liquid separator 4 under the two-phase mixture. The gas refrigerant separated in the gas-liquid separator 4 is introduced to the intermediate pressure portion of the compressor 1, that is, introduced between the intermediate cooler 1C and the second-stage compressing portion 1B. "n" represents a ph value at the outlet port of the gas-liquid separator 4. The refrigerant passed through the outlet port of the gas-liquid separator 4 reaches the suction port of the second-stage compressing portion 1B of "d", and is compressed in the second-stage compressing portion 1A. On the other hand, the liquid refrigerant separated in the gas-liquid separator 4 is circulated in the low pressure side circuit 9. "i" represents a ph value at the outlet port of the gas-liquid separator 4, "i" represents a ph value at the inlet port of one of the first capillary tube 12 and the second capillary tube 13, "k" represents a ph value at the outlet port of one of the first and second capillary tubes 12 and 13, and "l" represents a ph value at the outlet port of the heat absorber 14. The refrigerant of gas phase is passed through the check valve 8 and returned to the suction port of the first-stage compressing portion 1A of "a".

In the above construction, the gas refrigerant separated in the gas-liquid separator 4 is not usable for cooling even when it is circulated to the low pressure side circuit 9, and returning of this gas refrigerant to the suction port of the first-stage compressing portion 1A reduces the compression efficiency of the compressor 1.

In this construction, the gas refrigerant separated in the gas-liquid separator 4 is introduced to the intermediate pressure portion of the compressor 1, that is, between the intermediate cooler 1C and the second-stage compressing portion 1B, and thus the compression efficiency of the compressor 1 can be enhanced. In this embodiment, particularly carbon dioxide refrigerant is filled in the refrigerant circuit, and thus with respect to the ratio of gas and liquid which are separated from each other in the gas-liquid separator 4, the gas amount (the line segment h-i) is larger as compared with chlorofluorocarbon refrigerant, and the large amount of gas refrigerant is introduced to the intermediate pressure portion of the compressor 1 to thereby enhance the efficiency.

Under freezing operation, the amount of gas refrigerant separated in the gas-liquid separator 4 is larger than the refrigerating operation. According to this embodiment, at least the heat absorber 58 functioning in the low temperature zone is provided to the low pressure side circuit 9, and thus highly efficient freezing operation can be performed. Furthermore, in addition to this, the heat absorber 57 functioning in the high temperature zone is provided to low pressure side circuit 9 for circulating the liquid refrigerant separated in the gas-liquid separator 4. Therefore, not only the freezing operation, but also the refrigerating operation can be performed with very high efficiency.

Figure 4:
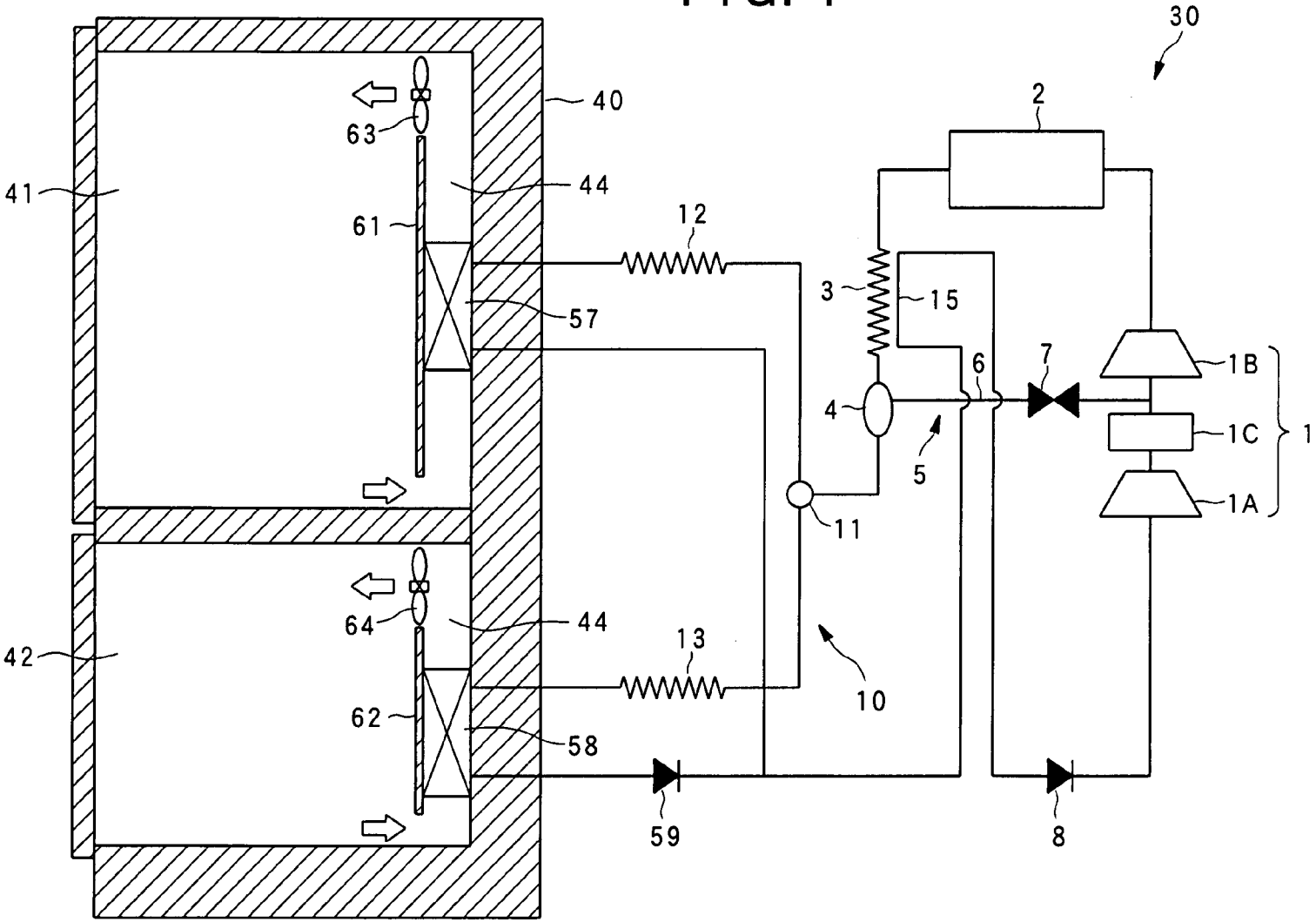
FIG. 4 is a diagram showing an applied example to a refrigerator.

FIG. 4 shows an applied example to a refrigerator.

The refrigerator 40 has a refrigerating chamber 41 at the upper stage and a freezing chamber 42 at the lower stage. Partition walls 61 and 62 are provided to the inner back sides of the chambers 41 and 42, and the heat absorbers 57 and 58 and fans 63 and 64 are disposed in air flow paths 44 partitioned by the inner partition walls 61 and 62, respectively. In this construction, the three-way valve 11 is switched in accordance with thermo-on or thermo-off of the refrigerating operation and freeing operation to make the refrigerant flow into any one of the heat absorbers 57 and 58, and the corresponding one of the fans 62 and 63 is driven. When the refrigerant flows into the heat absorber 57, cold air is supplied to the refrigerating chamber 41. When the refrigerant flows into the heat absorber 58, cold air is supplied to the freezing chamber 42.

Figure 5:
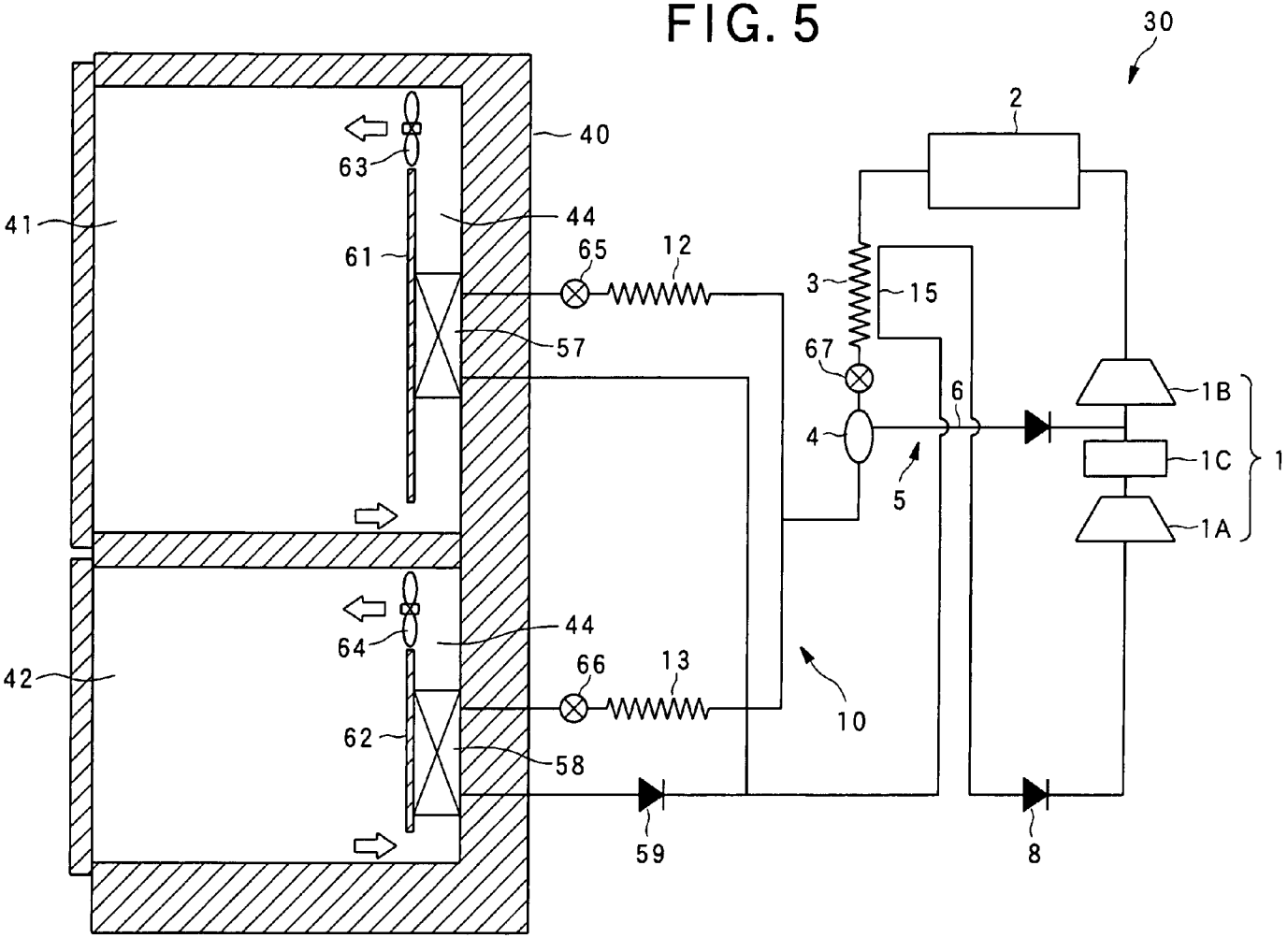
FIG. 5 is a diagram showing an applied example to a refrigerator.

FIG. 5 shows another construction.

This construction is different from that shown in FIG. 4 in the construction of the heat absorbing unit 10. In the heat absorbing unit 10, the three-way valve is omitted, and the capillary tubes 12 and 13 are connected to electric motor operated valves 65 and 66 in series respectively. Reference numeral 67 represents an electric motor operated valve. In this construction, the electric motor operated valves 65 and 66 are turned on or off in accordance with thermo-on or thermo-off of the refrigerating operation and freezing operation to make the refrigerant selectively flow into any one of the heat absorbers 57 and 58, and also the corresponding one of the fans 62 and 63 is driven. This embodiment can achieve substantially the same effect as described above.

Figure 6:
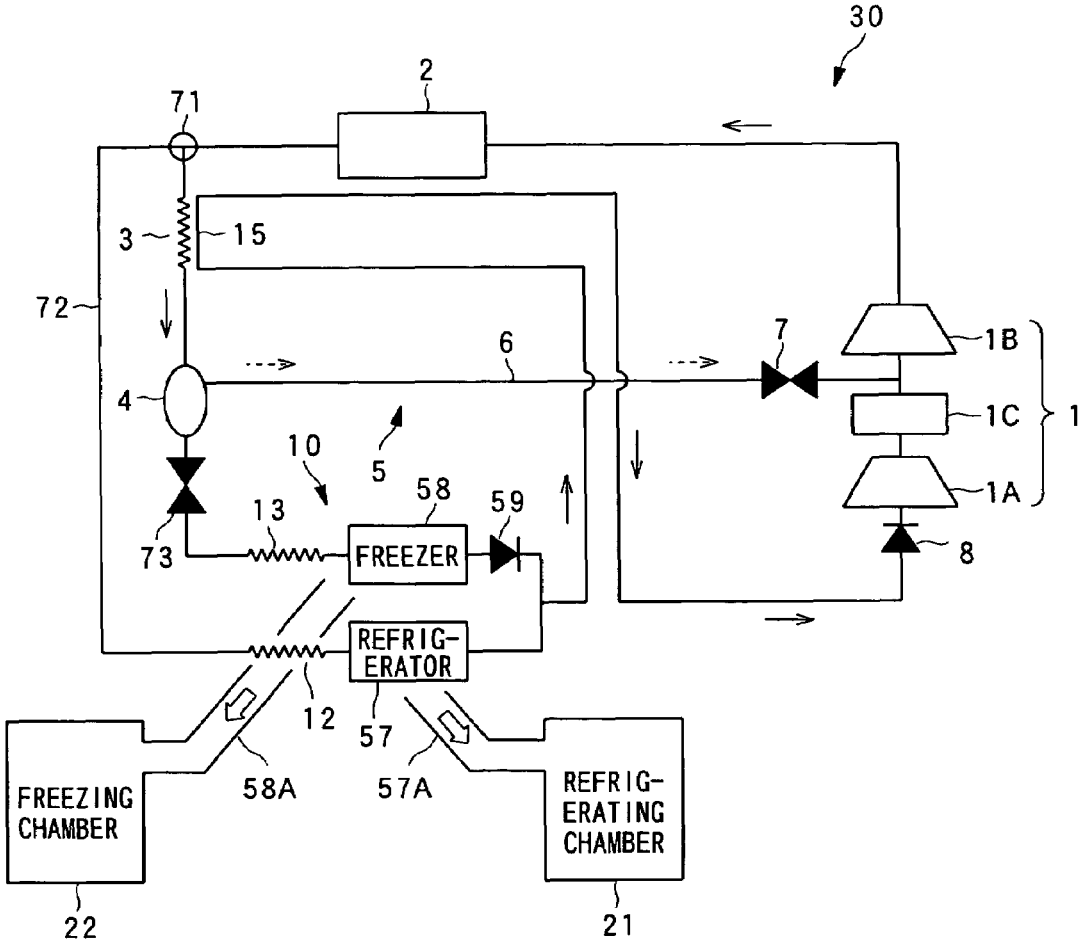
FIG. 6 is a diagram showing a refrigerant circuit according to another embodiment.

FIG. 6 shows another embodiment. In this embodiment, a bypass circuit for bypassing the pressure-reducing device 3, the gas-liquid separator 4 and the heat absorber 58 functioning in the low temperature zone through the three-way valve 71 is provided through the three-way valve 71 unlike the refrigerant circuit shown in FIG. 1, and the first capillary tube 12 and the heat absorber 57 for refrigeration which is connected to the first capillary tube 12 in series as described above are connected to the bypass circuit 72. Reference numeral 73 represents an opening/closing valve.

In this embodiment, the low pressure side circuit 9 is provided with at least the heat absorber 58 functioning in the low temperature, and thus the freezing operation in the low temperature zone can be performed with high efficiency. Furthermore, in this construction, under refrigerating operation, the opening/closing valve 73 is closed. Then, the refrigerant discharged from the compressor 1 is passed through the radiator 2, the pressure-reducing device 3 and the three-way valve 71 to the bypass circuit 72, and then passed from the three-way valve 71 through the first capillary tube 12, the heat absorber 57, the heat exchanger 15 and the check valve 8 and returned to the suction portion of the compressor 1. Accordingly, under refrigerating operation, the function of the introducing unit 5 for introducing the gas refrigerant separated in the gas-liquid separator 4 to the intermediate pressure portion of the compressor 1 is stopped. Since the occurrence amount of the gas refrigerant in the gas-liquid separator 4 under refrigerating operation is smaller than that under freezing operation, reduction in operation efficiency can be suppressed even when the operation of the introducing unit 5 is stopped.

Figure 7:
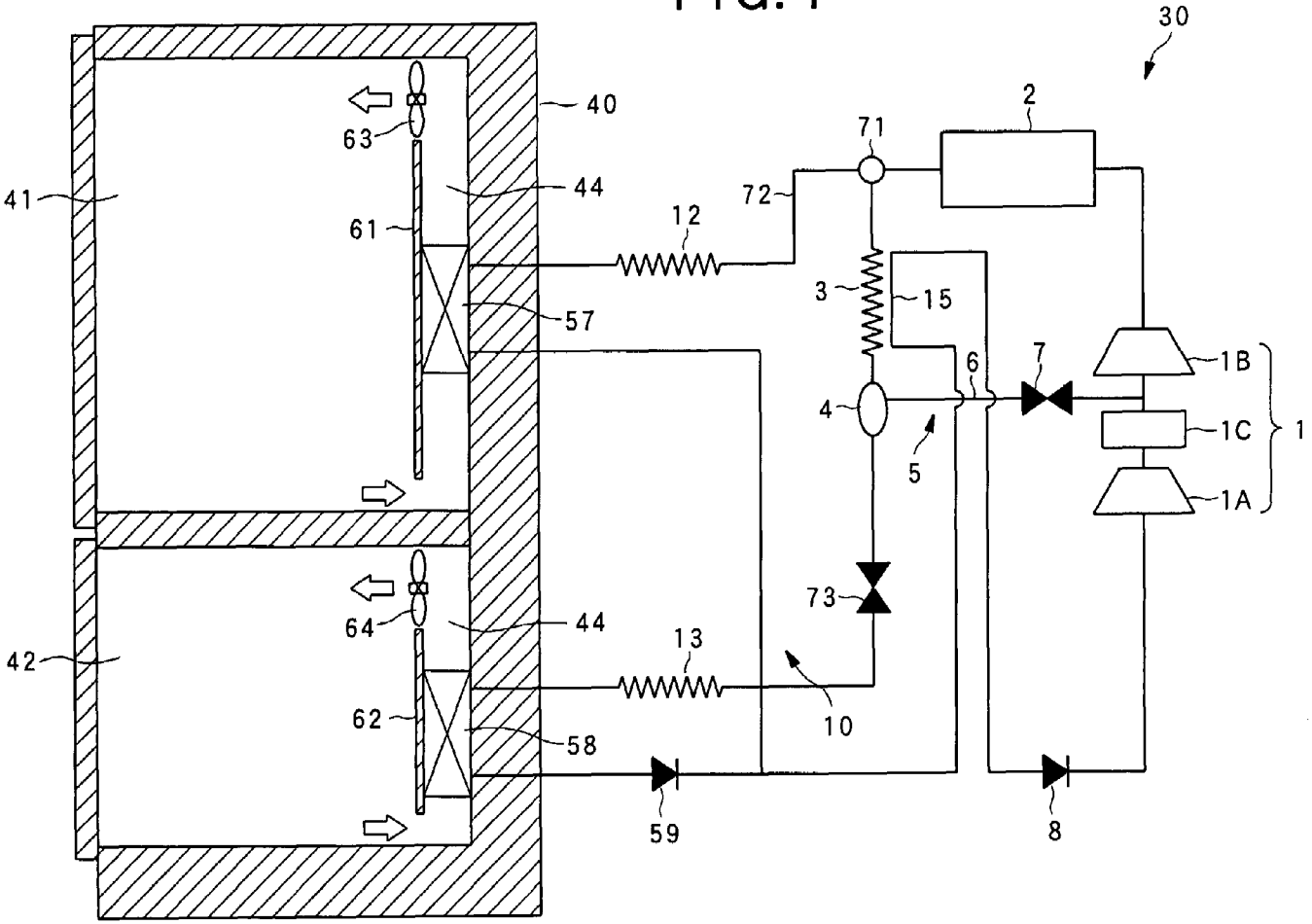
FIG. 7 is a diagram showing an applied example to a refrigerator.

FIG. 7 shows an applied example to a refrigerator.

The refrigerator 40 has a refrigerating chamber 41 at the upper stage, and a freezing chamber 42 at the lower stage. Inner partition walls 61 and 62 are provided at the inner back sides of the chambers 41 and 42 respectively, the heat absorbers 57 and 58 and the fans 63 and 64 are disposed in air flow paths partitioned by the inner partition walls 61 and 62, respectively. In this construction, under refrigerating operation, the three-way valve 71 is switched in accordance with thermo-on or thermo-off of refrigerating operation and freezing operation to make the refrigerant flow into any one of the heat absorbers 57 and 58, and the corresponding one of the fans 62 and 63 is driven. When the refrigerant flows into the heat absorber 57, cold air is supplied to the refrigerating chamber 41, and when the refrigerant flows into the heat absorber 58, cold air is supplied to the freezing chamber 42.

Figure 8:
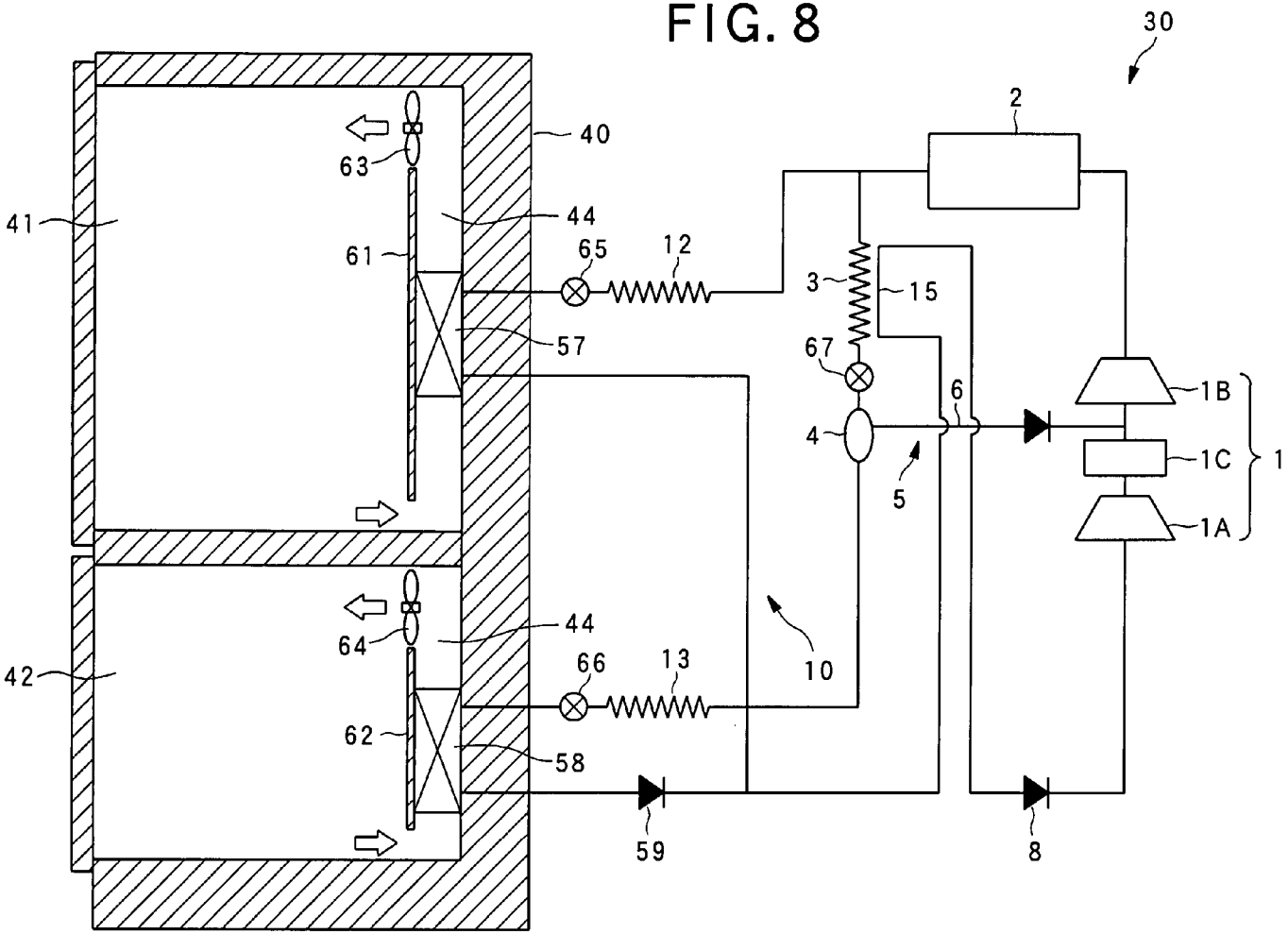
FIG. 8 is a diagram showing an applied example to a refrigerator.

FIG. 8 shows another construction. This construction is different from the construction shown in FIG. 7 in the heat absorbing unit 10. In the heat absorbing unit 10, the three-way valve 71 is omitted, and the electric motor operated valves 65 and 66 are connected to the capillary tubes 12 and 13 in series respectively. Reference numeral 67 represents an electric motor operated valve, and the opening/closing valve 73 is omitted. In this construction, the electric motor operated valves 65 and 66 are turned on or off in accordance with thermo-on or thermo-off of the refrigerating operation or freezing operation to male the refrigerant selectively flow into any one of the heat absorbers 57 and 58, and also the corresponding one of the fans 62 and 63 is driven. This embodiment can achieve substantially the same effect as described above.

Figure 9:
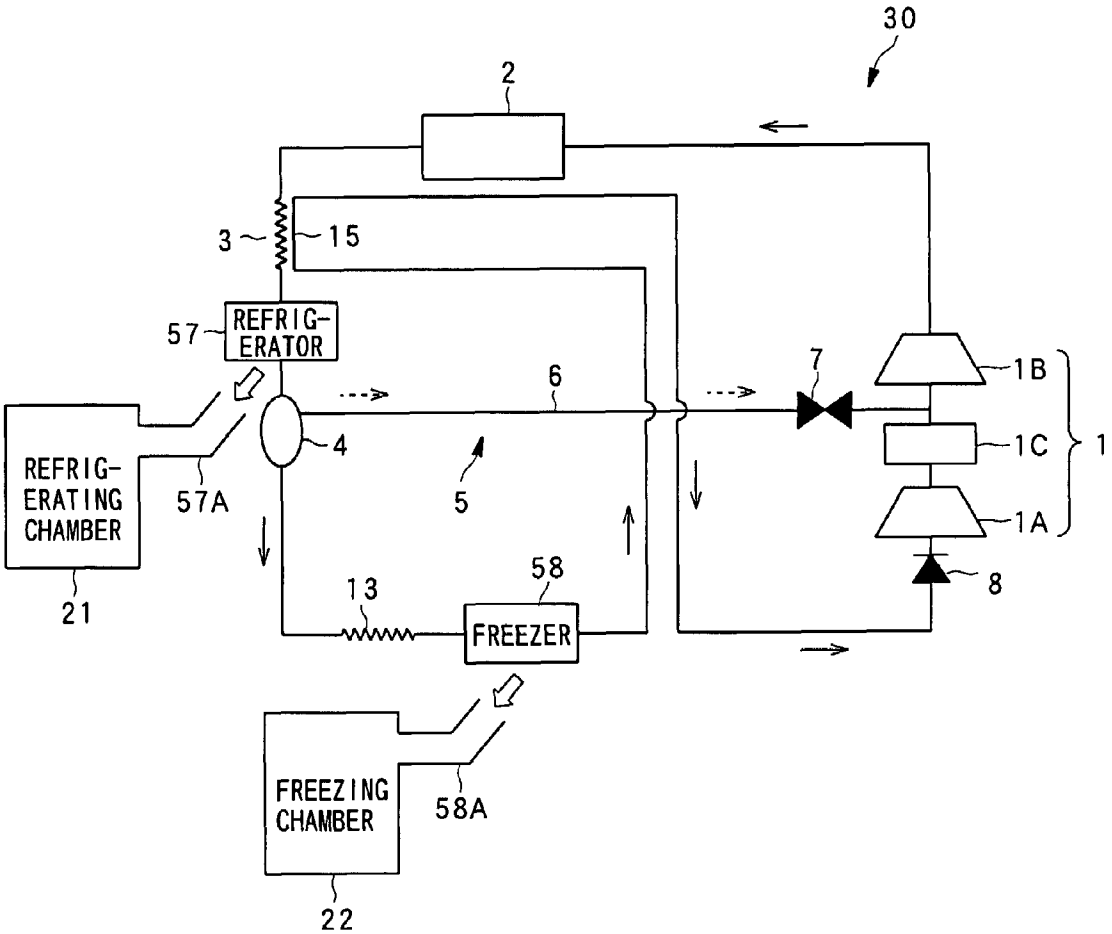
FIG. 9 is a refrigerant circuit diagram showing another embodiment.

FIG. 9 shows another embodiment.

This embodiment is different from the embodiment shown in FIG. 1 in the construction of the heat absorbing unit 10. That is, the heat absorber 58 functioning in the low temperature zone is disposed in the low pressure side circuit 9 subsequently to the gas-liquid separator 4 as in the case of the above construction, and the heating absorber 57 functioning in the high temperature zone is disposed between the pressure-reducing device 3 and the gas-liquid separator 4. In this construction, the low pressure side circuit 9 is provided with the heat absorber 58 functioning in the low temperature zone, and thus the freezing operation in the low temperature zone can be performed with high efficiency. Furthermore, in this construction, the heat exchange is carried out before gas-liquid separation under refrigerating operation, and thus the refrigeration efficiency is lowered. However, the reduction of the efficiency under refrigerating operation is not so large, and thus the whole efficiency can be enhanced. Furthermore, in this construction, the pressure-reducing device 3 functions under refrigerating operation, and thus the first capillary tube 12 may be omitted.

The present invention is not limited to the above embodiments, and various modifications may be made without departing from the subject matter of the present invention. For example, in the above constructions, carbon dioxide refrigerant is filled in the refrigerant circuit, however, the present invention is not limited to this refrigerant. chlorofluorocarbon (Freon) type refrigerant or the like may be used.

What is claimed is:

1. A refrigerating machine comprising:

a compressor;

a radiator;

a pressure-reducing device;

a gas-liquid separator;

plural kinds of absorbers functioning selectively in different temperature zones;

a unit for allowing introduction of gas refrigerant separated in the gas-liquid separator into an intermediate pressure portion of the compressor;

a low pressure side circuit in which liquid refrigerant separated in the gas-liquid separator is circulated, wherein the low pressure side circuit is provided with at least a heat absorber functioning in a low temperature zone; and a bypass circuit for bypassing the pressure-reducing device, the gas-liquid separator and an absorber functioning in a low temperature zone, wherein the bypass circuit is provided with an absorber functioning in a high temperature zone.

2. A refrigerating machine comprising:

a compressor;

a radiator;

a pressure-reducing device;

a gas-liquid separator;

plural kinds of absorbers functioning selectively in different temperature zones;

a unit for allowing introduction of gas refrigerant separated in the gas-liqiuid separator into an intermediate pressure portion of the compressor;

a low pressure side circuit in which liquid refrigerant separated in the gas-liquid separator is circulated, wherein the low pressure side circuit is provided with at least a heat absorber functioning in a low temperature zone; and an absorber functioning in a high temperature zone between the pressure-reducing device and the gas-liquid separator.

3. A refrigerating machine comprising:

a compressor;

a radiator;

a pressure-reducing device;

a gas-liquid separator;

plural kinds of absorbers functioning selectively in different temperature zones;

a unit for allowing introduction of gas refrigerant separated in the gas-liquid separator into an intermediate pressure portion of the compressor; and a low pressure side circuit in which liquid refrigerant separated in the gas-liquid separator is circulated, wherein the low pressure side circuit is provided with at least a heat absorber functioning in a low temperature zone;

wherein the refrigerant is refrigerant with which a high pressure side is set to supercritical pressure during operation.

* * * * *